US009709042B2

(12) United States Patent
Locke et al.

(10) Patent No.: US 9,709,042 B2
(45) Date of Patent: Jul. 18, 2017

(54) SYSTEMS AND METHODS FOR REGULATING THE RESONANT FREQUENCY OF A DISC PUMP CAVITY

(71) Applicant: KCI Licensing Inc., San Antonio, TX (US)

(72) Inventors: Christopher Brian Locke, Bournemouth (GB); Aidan Marcus Tout, Alderbury (GB)

(73) Assignee: KCI Licensing, Inc., San Antonio, TX (US)

( * ) Notice: Subject to any disclaimer, the term of this patent is extended or adjusted under 35 U.S.C. 154(b) by 871 days.

(21) Appl. No.: 13/935,024

(22) Filed: Jul. 3, 2013

(65) Prior Publication Data

US 2014/0017093 A1 Jan. 16, 2014

Related U.S. Application Data

(60) Provisional application No. 61/668,100, filed on Jul. 5, 2012.

(51) Int. Cl.
*F04B 17/03* (2006.01)
*F04B 43/04* (2006.01)
(Continued)

(52) U.S. Cl.
CPC ..... *F04B 17/00* (2013.01); *F04B 19/006* (2013.01); *F04B 43/04* (2013.01); *F04B 43/046* (2013.01); *F04F 7/00* (2013.01)

(58) Field of Classification Search
CPC ..... F04B 43/04; F04B 43/043; F04B 43/046; F04B 17/00; F04B 19/006; F05B 53/00; F04F 7/00
(Continued)

(56) References Cited

U.S. PATENT DOCUMENTS 1,355,846 A 10/1920 Rannells
1,977,458 A * 10/1934 Stargardter ..... F16F 1/10 185/45
(Continued)

FOREIGN PATENT DOCUMENTS

AU 550575 A1 3/1986
AU 745271 4/1999
(Continued)

OTHER PUBLICATIONS

N.A. Bagautdinov, "Variant of External Vacuum Aspiration in the Treatment of Purulent Diseases of the Soft Tissues," Current Problems in Modern Clinical Surgery: Interdepartmental Collection, edited by V. Ye Volkov et al. (Chuvashia State University, Cheboksary, U.S.S.R. 1986);pp. 94-96 (certified translation).
(Continued)

*Primary Examiner* — Nathan Zollinger

(57) ABSTRACT

A disc pump system includes a pump body having a substantially cylindrical shape defining a cavity for containing a fluid. The cavity having a resonant cavity frequency is formed by an internal sidewall and substantially closed at both ends by a first end wall and a driven end wall. The disc pump system includes an actuator that is driven a frequency (f) that corresponds to the fundamental resonant frequency of the actuator. The internal sidewall is configured to expand and contract in response to changes in temperature, thereby causing the actuator and cavity to have approximately the same resonant frequencies over a range of operating temperatures.

10 Claims, 10 Drawing Sheets

(51) Int. Cl.
*F04F 7/00* (2006.01)
*F04B 17/00* (2006.01)
*F04B 19/00* (2006.01)

(58) Field of Classification Search
USPC ..... 417/413.1, 413.2, 413.3
See application file for complete search history.

(56) References Cited

U.S. PATENT DOCUMENTS

| | | | | |
|---|---|---|---|---|
| 2,547,758 | A | | 4/1951 | Keeling |
| 2,632,443 | A | | 3/1953 | Lesher |
| 2,682,873 | A | | 7/1954 | Evans et al. |
| 2,910,763 | A | | 11/1959 | Lauterbach |
| 2,969,057 | A | | 1/1961 | Simmons |
| 3,066,672 | A | | 12/1962 | Crosby, Jr. et al. |
| 3,367,332 | A | | 2/1968 | Groves |
| 3,520,300 | A | | 7/1970 | Flower, Jr. |
| 3,568,675 | A | | 3/1971 | Harvey |
| 3,648,692 | A | | 3/1972 | Wheeler |
| 3,682,180 | A | | 8/1972 | McFarlane |
| 3,826,254 | A | | 7/1974 | Mellor |
| 4,080,970 | A | | 3/1978 | Miller |
| 4,096,853 | A | | 6/1978 | Weigand |
| 4,139,004 | A | | 2/1979 | Gonzalez, Jr. |
| 4,165,748 | A | | 8/1979 | Johnson |
| 4,184,510 | A | | 1/1980 | Murry et al. |
| 4,231,287 | A | * | 11/1980 | Smiley ..... F04B 43/0054 417/413.1 |
| 4,233,969 | A | | 11/1980 | Lock et al. |
| 4,245,630 | A | | 1/1981 | Lloyd et al. |
| 4,256,109 | A | | 3/1981 | Nichols |
| 4,261,363 | A | | 4/1981 | Russo |
| 4,275,721 | A | | 6/1981 | Olson |
| 4,284,079 | A | | 8/1981 | Adair |
| 4,297,995 | A | | 11/1981 | Golub |
| 4,333,468 | A | | 6/1982 | Geist |
| 4,373,519 | A | | 2/1983 | Errede et al. |
| 4,382,441 | A | | 5/1983 | Svedman |
| 4,392,853 | A | | 7/1983 | Muto |
| 4,392,858 | A | | 7/1983 | George et al. |
| 4,419,097 | A | | 12/1983 | Rowland |
| 4,465,485 | A | | 8/1984 | Kashmer et al. |
| 4,475,909 | A | | 10/1984 | Eisenberg |
| 4,480,638 | A | | 11/1984 | Schmid |
| 4,525,166 | A | | 6/1985 | Leclerc |
| 4,525,374 | A | | 6/1985 | Vaillancourt |
| 4,540,412 | A | | 9/1985 | Van Overloop |
| 4,543,100 | A | | 9/1985 | Brodsky |
| 4,548,202 | A | | 10/1985 | Duncan |
| 4,551,139 | A | | 11/1985 | Plaas et al. |
| 4,569,348 | A | | 2/1986 | Hasslinger |
| 4,605,399 | A | | 8/1986 | Weston et al. |
| 4,608,041 | A | | 8/1986 | Nielson |
| 4,640,688 | A | | 2/1987 | Hauser |
| 4,655,754 | A | | 4/1987 | Richmond et al. |
| 4,664,662 | A | | 5/1987 | Webster |
| 4,710,165 | A | | 12/1987 | McNeil et al. |
| 4,733,659 | A | | 3/1988 | Edenbaum et al. |
| 4,743,232 | A | | 5/1988 | Kruger |
| 4,758,220 | A | | 7/1988 | Sundblom et al. |
| 4,787,888 | A | | 11/1988 | Fox |
| 4,826,494 | A | | 5/1989 | Richmond et al. |
| 4,838,883 | A | | 6/1989 | Matsuura |
| 4,840,187 | A | | 6/1989 | Brazier |
| 4,863,449 | A | | 9/1989 | Therriault et al. |
| 4,872,450 | A | | 10/1989 | Austad |
| 4,878,901 | A | | 11/1989 | Sachse |
| 4,897,081 | A | | 1/1990 | Poirier et al. |
| 4,906,233 | A | | 3/1990 | Moriuchi et al. |
| 4,906,240 | A | | 3/1990 | Reed et al. |
| 4,919,654 | A | | 4/1990 | Kalt et al. |
| 4,941,882 | A | | 7/1990 | Ward et al. |
| 4,953,565 | A | | 9/1990 | Tachibana et al. |
| 4,969,880 | A | | 11/1990 | Zamierowski |
| 4,985,019 | A | | 1/1991 | Michelson |
| 5,037,397 | A | | 8/1991 | Kalt et al. |
| 5,086,170 | A | | 2/1992 | Luheshi et al. |
| 5,092,858 | A | | 3/1992 | Benson et al. |
| 5,100,396 | A | | 3/1992 | Zamierowski |
| 5,134,994 | A | | 8/1992 | Say |
| 5,149,331 | A | | 9/1992 | Ferdman et al. |
| 5,167,613 | A | | 12/1992 | Karami et al. |
| 5,176,663 | A | | 1/1993 | Svedman et al. |
| 5,215,522 | A | | 6/1993 | Page et al. |
| 5,232,453 | A | | 8/1993 | Plass et al. |
| 5,261,893 | A | | 11/1993 | Zamierowski |
| 5,278,100 | A | | 1/1994 | Doan et al. |
| 5,279,550 | A | | 1/1994 | Habib et al. |
| 5,298,015 | A | | 3/1994 | Komatsuzaki et al. |
| 5,342,376 | A | | 8/1994 | Ruff |
| 5,344,415 | A | | 9/1994 | DeBusk et al. |
| 5,358,494 | A | | 10/1994 | Svedman |
| 5,437,622 | A | | 8/1995 | Carion |
| 5,437,651 | A | | 8/1995 | Todd et al. |
| 5,527,293 | A | | 6/1996 | Zamierowski |
| 5,549,584 | A | | 8/1996 | Gross |
| 5,556,375 | A | | 9/1996 | Ewall |
| 5,607,292 | A | * | 3/1997 | Rao ..... F04B 17/044 417/410.1 |
| 5,607,388 | A | | 3/1997 | Ewall |
| 5,636,643 | A | | 6/1997 | Argenta et al. |
| 5,645,081 | A | | 7/1997 | Argenta et al. |
| 6,071,267 | A | | 6/2000 | Zamierowski |
| 6,104,127 | A | | 8/2000 | Kameyama et al. |
| 6,135,116 | A | | 10/2000 | Vogel et al. |
| 6,241,747 | B1 | | 6/2001 | Ruff |
| 6,287,316 | B1 | | 9/2001 | Agarwal et al. |
| 6,345,623 | B1 | | 2/2002 | Heaton et al. |
| 6,488,643 | B1 | | 12/2002 | Tumey et al. |
| 6,493,568 | B1 | | 12/2002 | Bell et al. |
| 6,553,998 | B2 | | 4/2003 | Heaton et al. |
| 6,814,079 | B2 | | 11/2004 | Heaton et al. |
| 7,544,873 | B1 | * | 6/2009 | Stets ..... G10D 3/146 84/298 |
| 8,062,007 | B2 | * | 11/2011 | Ikushima ..... F04B 35/04 417/395 |
| 8,123,502 | B2 | * | 2/2012 | Blakey ..... F04B 43/046 417/413.1 |
| 9,051,931 | B2 | * | 6/2015 | Locke ..... F04B 53/08 |
| 2002/0077661 | A1 | | 6/2002 | Saadat |
| 2002/0115951 | A1 | | 8/2002 | Norstrem et al. |
| 2002/0120185 | A1 | | 8/2002 | Johnson |
| 2002/0143286 | A1 | | 10/2002 | Tumey |
| 2006/0079852 | A1 | | 4/2006 | Bubb et al. |
| 2009/0087323 | A1 | * | 4/2009 | Blakey ..... F04B 43/046 417/413.2 |
| 2010/0310398 | A1 | | 12/2010 | Janse Van Rensburg et al. |

FOREIGN PATENT DOCUMENTS

| | | | | |
|---|---|---|---|---|
| AU | 755496 | | 2/2002 | |
| CA | 2005436 | | 6/1990 | |
| CH | EP 0654258 | A1 * | 5/1995 | ..... A61J 9/02 |
| DE | 26 40 413 | A1 | 3/1978 | |
| DE | 43 06 478 | A1 | 9/1994 | |
| DE | 295 04 378 | U1 | 10/1995 | |
| EP | 0100148 | A1 | 2/1984 | |
| EP | 0117632 | A2 | 9/1984 | |
| EP | 0161865 | A2 | 11/1985 | |
| EP | 0358302 | A2 | 3/1990 | |
| EP | 1018967 | B1 | 8/2004 | |
| GB | 692578 | | 6/1953 | |
| GB | 2 195 255 | A | 4/1988 | |
| GB | 2 197 789 | A | 6/1988 | |
| GB | 2 220 357 | A | 1/1990 | |
| GB | 2 235 877 | A | 3/1991 | |
| GB | 2 329 127 | B | 3/1999 | |
| GB | 2 333 965 | A | 8/1999 | |
| JP | 4129536 | | 4/1992 | |
| SG | 71559 | | 4/2002 | |
| WO | 80/02182 | | 10/1980 | |
| WO | 87/04626 | | 8/1987 | |
| WO | 90/10424 | | 9/1990 | |

(56) References Cited

FOREIGN PATENT DOCUMENTS

| | | |
|---|---|---|
| WO | 93/09727 | 5/1993 |
| WO | 94/20041 | 9/1994 |
| WO | 96/05873 | 2/1996 |
| WO | 97/18007 | 5/1997 |
| WO | 99/13793 | 3/1999 |
| WO | 2010139916 A1 | 12/2010 |

OTHER PUBLICATIONS

Louis C. Argenta, MD and Michael J. Morykwas, PhD; "Vacuum-Assisted Closure: A New Method for Wound Control and Treatment: Animal Studies & Basic Foundation"; Annals of Plastic Surgery, vol. 38, No. 6, Jun. 1997; pp. 553-562.
Susan Mendez-Eastmen, RN; "When Wounds Won't Heal" RN Jan. 1998, vol. 61 (1); Medical Economics Company, Inc., Montvale, NJ, USA; pp. 20-24.
James H. Blackburn, II, MD, et al; "Negative-Pressure Dressings as a Bolster for Skin Grafts"; Annals of Plastic Surgery, vol. 40, No. 5, May 1998, pp. 453-457.
John Masters; "Reliable, Inexpensive and Simple Suction Dressings"; Letters to the Editor, British Journal of Plastic Surgery, 1998, vol. 51 (3), p. 267; Elsevier Science/The British Association of Plastic Surgeons, UK.
S.E. Greer, et al "The Use of Subatmospheric Pressure Dressing Therapy to Close Lymphocutaneous Fistulas of the Groin" British Journal of Plastic Surgery (2000), vol. 53, pp. 484-487.
George V. Letsou, MD., et al; "Stimulation of Adenylate Cyclase Activity in Cultured Endothelial Cells Subjected to Cyclic Stretch"; Journal of Cardiovascular Surgery, vol. 31, 1990, pp. 634-639.
Orringer, Jay, et al; "Management of Wounds in Patients with Complex Enterocutaneous Fistulas"; Surgery, Gynecology & Obstetrics, Jul. 1987, vol. 165, pp. 79-80.
International Search Report for PCT International Application PCT/GB95/01983; Nov. 23, 1995.
PCT International Search Report for PCT International Application PCT/GB98/02713; Jan. 8, 1999.
PCT Written Opinion; PCT International Application PCT/GB98/02713; Jun. 8, 1999.
PCT International Examination and Search Report, PCT International Application PCT/GB96/02802; Jan. 15, 1998 & Apr. 29, 1997.
PCT Written Opinion, PCT International Application PCT/GB96/02802; Sep. 3, 1997.
Dattilo, Philip P., Jr., et al; "Medical Textiles: Application of an Absorbable Barbed Bi-directional Surgical Suture"; Journal of Textile and Apparel, Technology and Management, vol. 2, Issue 2, Spring 2002, pp. 1-5.
Kostyuchenok, B.M., et al; "Vacuum Treatment in the Surgical Management of Purulent Wounds"; Vestnik Khirurgi, Sep. 1986, pp. 18-21 and 6 page English translation thereof.
Davydov, Yu. A., et al; "Vacuum Therapy in the Treatment of Purulent Lactation Mastitis"; Vestnik Khirurgi, May 14, 1986, pp. 66-70, and 9 page English translation thereof.
Yusupov. Yu. N., et al; "Active Wound Drainage", Vestnik Khirurgi, vol. 138, Issue 4, 1987, and 7 page English translation thereof.
Davydov, Yu. A., et al; "Bacteriological and Cytological Assessment of Vacuum Therapy for Purulent Wounds"; Vestnik Khirurgi, Oct. 1988, pp. 48-52, and 8 page English translation thereof.
Davydov, Yu. A., et al; "Concepts for the Clinical-Biological Management of the Wound Process in the Treatment of Purulent Wounds by Means of Vacuum Therapy"; Vestnik Khirurgi, Jul. 7, 1980, pp. 132-136, and 8 page English translation thereof.
Chariker, Mark E., M.D., et al; "Effective Management of incisional and cutaneous fistulae with closed suction wound drainage"; Contemporary Surgery, vol. 34, Jun. 1989, pp. 59-63.
Egnell Minor, Instruction Book, First Edition, 300 7502, Feb. 1975, pp. 24.
Egnell Minor: Addition to the Users Manual Concerning Overflow Protection—Concerns all Egnell Pumps, Feb. 3, 1983, p. 1.
Svedman, P.: "Irrigation Treatment of Leg Ulcers", The Lancet, Sep. 3, 1983, pp. 532-534.
Chinn, Steven D. et al.: "Closed Wound Suction Drainage", The Journal of Foot Surgery, vol. 24, No. 1, 1985, pp. 76-81.
Arnljots, Bjorn et al.: "Irrigation Treatment in Split-Thickness Skin Grafting of Intractable Leg Ulcers", Scand J. Plast Reconstr. Surg., vol. 19, 1985, pp. 211-213.
Svedman, P.: "A Dressing Allowing Continuous Treatment of a Biosurface", IRCS Medical Science: Biomedical Technology, Clinical Medicine, Surgery and Transplantation, vol. 7, 1979, p. 221.
Svedman, P. et al.: "A Dressing System Providing Fluid Supply and Suction Drainage Used for Continuous or Intermittent Irrigation", Annals of Plastic Surgery, vol. 17, No. 2, Aug. 1986, pp. 125-133.
K.F. Jeter, T.E. Tintle, and M. Chariker, "Managing Draining Wounds and Fistulae: New and Established Methods," Chronic Wound Care, edited by D. Krasner (Health Management Publications, Inc., King of Prussia, PA 1990), pp. 240-246.
G. Živadinovic, V. Đ ukić, Ž. Maksimović, Đ . Radak, and P. Peška, "Vacuum Therapy in the Treatment of Peripheral Blood Vessels," Timok Medical Journal 11 (1986), pp. 161-164 (certified translation).
F.E. Johnson, "An Improved Technique for Skin Graft Placement Using a Suction Drain," Surgery, Gynecology, and Obstetrics 159 (1984), pp. 584-585.
A.A. Safronov, Dissertation Abstract, Vacuum Therapy of Trophic Ulcers of the Lower Leg with Simultaneous Autoplasty of the Skin (Central Scientific Research Institute of Traumatology and Orthopedics, Moscow, U.S.S.R. 1967) (certified translation).
M. Schein, R. Saadia, J.R. Jamieson, and G.A.G. Decker, "The 'Sandwich Technique' in the Management of the Open Abdomen," British Journal of Surgery 73 (1986), pp. 369-370.
D.E. Tribble, "An Improved Sump Drain-Irrigation Device of Simple Construction," Archives of Surgery 105 (1972) pp. 511-513.
C.E. Tennant, "The Use of Hypermia in the Postoperative Treatment of Lesions of the Extremities and Thorax," Journal of the American Medical Association 64 (1915), pp. 1548-1549.
Selections from W. Meyer and V. Schmieden, Bier's Hyperemic Treatment in Surgery, Medicine, and the Specialties: A Manual of Its Practical Application, (W.B. Saunders Co., Philadelphia, PA 1909), pp. 17-25, 44-64, 90-96, 167-170, and 210-211.
V.A. Solovev et al., Guidelines, The Method of Treatment of Immature External Fistulas in the Upper Gastrointestinal Tract, editor-in-chief Prov. V.I. Parahonyak (S.M. Kirov Gorky State Medical Institute, Gorky, U.S.S.R. 1987) ("Solovev Guidelines").
V.A. Kuznetsov & N.A. Bagautdinov, "Vacuum and Vacuum-Sorption Treatment of Open Septic Wounds," in II All-Union Conference on Wounds and Wound Infections: Presentation Abstracts, edited by B.M. Kostyuchenok et al. (Moscow, U.S.S.R. Oct. 28-29, 1986) pp. 91-92 ("Bagautdinov II").
V.A. Solovev, Dissertation Abstract, Treatment and Prevention of Suture Failures after Gastric Resection (S.M. Kirov Gorky State Medical Institute, Gorky, U.S.S.R. 1988) ("Solovev Abstract").
V.A.C.® Therapy Clinical Guidelines: A Reference Source for Clinicians (Jul. 2007).
International Search Report and Written Opinion for corresponding PCT/US2013/049249 mailed Dec. 9, 2013.

* cited by examiner

SYSTEMS AND METHODS FOR REGULATING THE RESONANT FREQUENCY OF A DISC PUMP CAVITY

The present invention claims the benefit, under 35 USC §119(e), of the filing of U.S. Provisional Patent Application Ser. No. 61/668,100, entitled "Systems and Methods for Regulating the Resonant Frequency of a Disc Pump," filed Jul. 5, 2012, by Locke et al., which is incorporated herein by reference for all purposes.

BACKGROUND OF THE INVENTION

1. Field of the Invention

The illustrative embodiments of the invention relate generally to a disc pump for pumping fluid and, more specifically, to a disc pump in which the pumping cavity is formed by an internal sidewall and opposing end walls. The illustrative embodiments of the invention relate more specifically to a disc pump with a cavity that has a variable resonant frequency.

2. Description of Related Art

The generation of high amplitude pressure oscillations in closed cavities has received significant attention in the fields of thermo-acoustics and disc pump type compressors. Recent developments in non-linear acoustics have allowed the generation of pressure waves with higher amplitudes than previously thought possible.

It is known to use acoustic resonance to achieve fluid pumping from defined inlets and outlets. This can be achieved using a cylindrical cavity with an acoustic driver at one end, which drives an acoustic standing wave. In such a cylindrical cavity, the acoustic pressure wave has limited amplitude. Varying cross-section cavities, such as cone, horn-cone, and bulb have been used to achieve high amplitude pressure oscillations thereby significantly increasing the pumping effect. In such high amplitude waves, the non-linear mechanisms with energy dissipation have been suppressed. However, high amplitude acoustic resonance has not been employed within disc-shaped cavities in which radial pressure oscillations are excited until recently. International Patent Application No. PCT/GB2006/001487, published as WO 2006/111775, discloses a disc pump having a substantially disc-shaped cavity with a high aspect ratio, i.e., the ratio of the radius of the cavity to the height of the cavity.

Such a disc pump has a substantially cylindrical cavity comprising a sidewall closed at each end by end walls. The disc pump also comprises an actuator that drives either one of the end walls to oscillate in a direction substantially perpendicular to the surface of the driven end wall. The spatial profile of the motion of the driven end wall is described as being matched to the spatial profile of the fluid pressure oscillations within the cavity, a state described herein as mode-matching. When the disc pump is mode-matched, work done by the actuator on the fluid in the cavity adds constructively across the driven end wall surface, thereby enhancing the amplitude of the pressure oscillation in the cavity and delivering high disc pump efficiency. The efficiency of a mode-matched disc pump is dependent upon the interface between the driven end wall and the side wall. It is desirable to maintain the efficiency of such disc pump by structuring the interface so that it does not decrease or dampen the motion of the driven end wall thereby mitigating any reduction in the amplitude of the fluid pressure oscillations within the cavity.

The actuator of the disc pump described above causes an oscillatory motion of the driven end wall ("displacement oscillations") in a direction substantially perpendicular to the end wall or substantially parallel to the longitudinal axis of the cylindrical cavity, referred to hereinafter as "axial oscillations" of the driven end wall within the cavity. The axial oscillations of the driven end wall generate substantially proportional "pressure oscillations" of fluid within the cavity creating a radial pressure distribution approximating that of a Bessel function of the first kind as described in International Patent Application No PCT/GB2006/001487, which is incorporated by reference herein, such oscillations, referred to hereinafter as "radial oscillations" of the fluid pressure within the cavity. A portion of the driven end wall between the actuator and the sidewall provides an interface with the sidewall of the disc pump that decreases dampening of the displacement oscillations to mitigate any reduction of the pressure oscillations within the cavity. The portion of the driven end wall between the actuator and the sidewall is hereinafter referred to as an "isolator" and is described more specifically in U.S. patent application Ser. No. 12/477,594 which is incorporated by reference herein. The illustrative embodiments of the isolator are operatively associated with the peripheral portion of the driven end wall to reduce dampening of the displacement oscillations.

Such disc pumps also require one or more valves for controlling the flow of fluid through the disc pump and, more specifically, valves being capable of operating at high frequencies. Conventional valves typically operate at lower frequencies below 500 Hz for a variety of applications. For example, many conventional compressors typically operate at 50 or 60 Hz. Linear resonance compressors known in the art operate between 150 and 350 Hz. However, many portable electronic devices including medical devices require disc pumps for delivering a positive pressure or providing a vacuum that are relatively small and it is advantageous for such disc pumps to be inaudible in operation to provide discrete operation. To achieve these objectives, such disc pumps must operate at very high frequencies requiring valves capable of operating at about 20 kHz and higher. To operate at these high frequencies, the valve must be responsive to a high frequency oscillating pressure that can be rectified to create a net flow of fluid through the disc pump.

Such a valve is described more specifically in International Patent Application No. PCT/GB2009/050614, which is incorporated by reference herein. Valves may be disposed in either the first or second aperture, or both apertures, for controlling the flow of fluid through the disc pump. Each valve comprises a first plate having apertures extending generally perpendicular therethrough and a second plate also having apertures extending generally perpendicular therethrough, wherein the apertures of the second plate are substantially offset from the apertures of the first plate. The valve further comprises a sidewall disposed between the first and second plate, wherein the sidewall is closed around the perimeter of the first and second plates to form a cavity between the first and second plates in fluid communication with the apertures of the first and second plates. The valve further comprises a flap disposed and moveable between the first and second plates, wherein the flap has apertures substantially offset from the apertures of the first plate and substantially aligned with the apertures of the second plate. The flap is motivated between the first and second plates in response to a change in direction of the differential pressure of the fluid across the valve.

SUMMARY

According to an illustrative embodiment, a disc pump system includes a pump body having a substantially cylindrical shape defining a cavity for containing a fluid. The cavity is formed by an internal sidewall closed at both ends by a first end wall and a driven end wall having a central portion and a peripheral portion extending radially outwardly from the central portion. The disc pump system includes an actuator operatively associated with the central portion of the driven end wall to cause an oscillatory motion of the driven end wall at a frequency (f), thereby generating displacement oscillations of the driven end wall in a direction substantially perpendicular thereto. The frequency (f) being about equal to a fundamental bending mode of the actuator. The disc pump system also includes a drive circuit having an output electrically coupled to the actuator for providing the drive signal to the actuator at the at the frequency (f), as well as an isolator operatively associated with the peripheral portion of the driven end wall to reduce dampening of the displacement oscillations. A first aperture is disposed at any location in either one of the end walls other than at the annular node and extending through the pump body. Similarly, a second aperture is disposed at any location in the pump body other than the location of the first aperture and extending through the pump body. A valve is disposed in at least one of the first aperture and the second aperture, and the displacement oscillations generate corresponding pressure oscillations of the fluid within the cavity of the pump body causing fluid flow through the first aperture and second aperture.

According to another illustrative embodiment, an internal sidewall for compensating for changes in the resonant frequency of a disc pump cavity resulting from changes in temperature is disclosed. The internal sidewall includes a circular coil configured to expand in response to an increase in temperature and contract in response to a decrease in temperature.

According to another illustrative embodiment, a method for varying a resonant cavity frequency ($f_c$) of a cavity of a disc pump includes providing an internal sidewall that comprises a circular coil. The circular coil defines the diameter of the cavity and has an inner diameter that increases in response to an increase in temperature and decreases in response to a decrease in temperature. The method includes coupling an end of the circular coil to an end wall of the cavity of the disc pump. The rate of increase in the inner diameter and rate of decrease in the inner diameter effect a change in the resonant cavity frequency ($f_c$) that is equivalent to a rate of temperature-related change of a resonant frequency of an actuator of the disc pump.

Other features and advantages of the illustrative embodiments will become apparent with reference to the drawings and detailed description that follow.

DETAILED DESCRIPTION OF ILLUSTRATIVE EMBODIMENTS

Figure 1A:
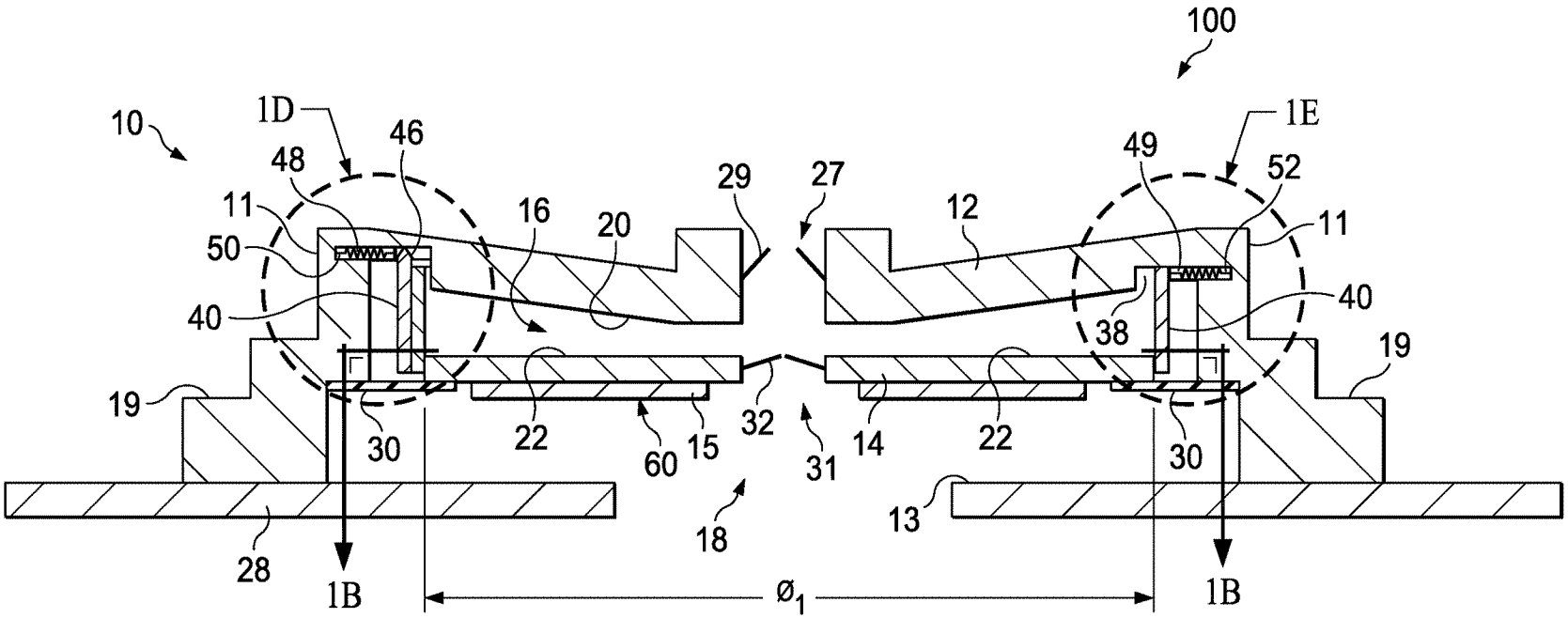
FIG. 1A is a cross-section view of a disc pump having an internal sidewall.
Figure 1B:
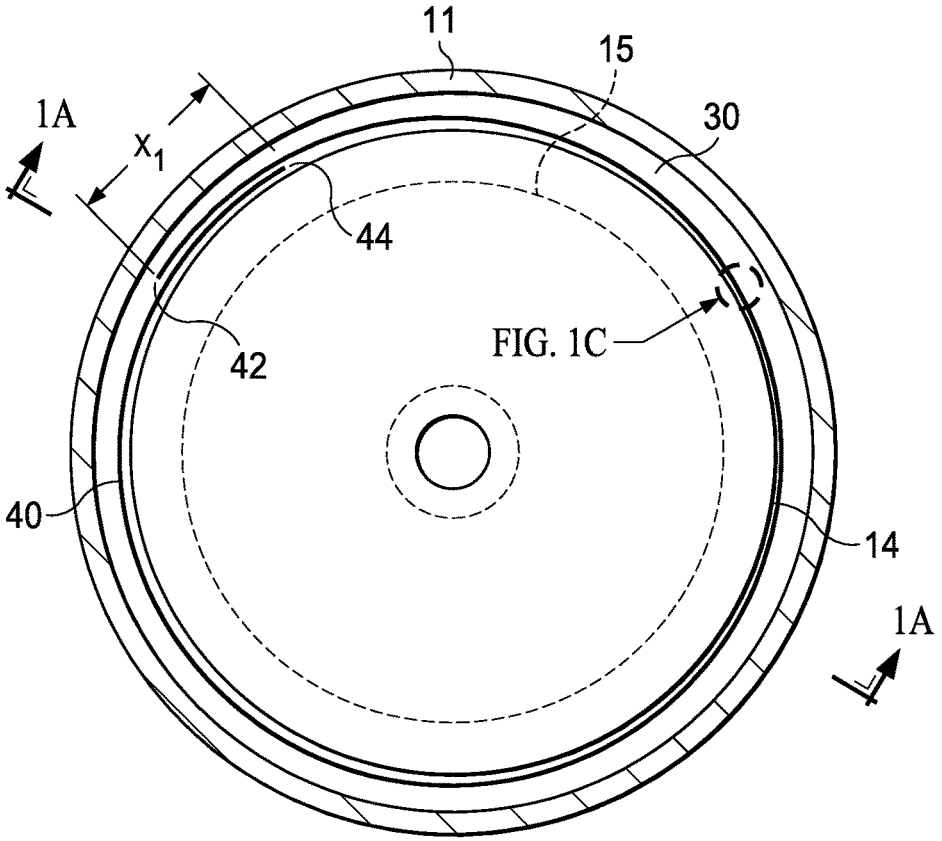
FIG. 1B is a top, section view of the disc pump of FIG. 1A taken along the line 1B-1B.

In the following detailed description of illustrative embodiments, reference is made to the accompanying drawings that form a part hereof. By way of illustration, the accompanying drawings show specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments are defined only by the appended claims.

FIGS. 1A-1E show an illustrative embodiment of a disc pump system 100 having a variable cavity size. The disc pump system 100 comprises a disc pump 10 mounted on a substrate 28 having an opening 18 fluidly coupled to a load to supply positive or negative pressure to the load. The disc pump 10 comprises a disc pump body having a substantially elliptical shape including a cylindrical wall 11 closed at one end by an end plate 12. The disc pump body also comprises a cylindrical leg structure 19 extending generally longitudinally from the cylindrical wall 11. The cylindrical leg structure 19 is coupled to the substrate 28 to form a closed base mounted to the substrate 28. The portion of the substrate 28 covered by the cylindrical leg structure 19 forms an end plate 13 that closes the other end of the disc pump 10 except for the opening 18. The substrate 28 may be a printed circuit board or another suitable rigid or semi-rigid material. The disc pump 10 further comprises a pair of disc-shaped interior plates 14, 15 supported within the disc pump 10 by an isolator 30 affixed to the cylindrical wall 11 of the disc pump body. The isolator 30 has a first side facing the end plate 12 and a second side facing the end plate 13. The isolator 30 comprises a flexible material and may be generally ring-shaped. The internal surface of the end plate 12 forms an end wall 20, while the internal surface of the interior plate 14 and the first side of the isolator 30 form an end wall 22. The end wall 22 thus comprises a central portion corresponding to the inside surface of the interior plate 14 and a peripheral portion corresponding to the inside surface of the ring-shaped isolator 30. Although the disc pump 10 and its components are substantially elliptical in shape, the specific embodiment disclosed herein is generally circular.

The disc pump 10 further comprises an internal sidewall having a variable diameter that is disposed within the pump body and, more specifically, within the cylindrical wall 11. The internal sidewall may be, for example, an inner wall 17 of a flat coil 40 having the appearance of a mainspring wherein the coil 40 has an outside wall 41 with a diameter restricted by the size of the cylindrical wall 11. The inner wall 17 of the coil 40 forms a cavity 16 with the end walls 20, 22 so that the cavity 16 also has a variable diameter. In FIG. 1A, the cavity 16 has an initial diameter ($\acute{Ø}_1$) at ambient temperature. The coil 40 further comprises a first end 42 and a second end 44, wherein a portion 40' of the coil 40 adjacent the second end 44 is overlapped by a portion of the inside wall 17 adjacent the first end 42 of the coil 40 by an initial circumferential length ($x_1$) when the pump 10 is at ambient temperature. The first end 42 of the coil 40 may be fixed in position so that it does not move circumferentially within the cavity 16. A circumferential groove 38 is formed in the end plate 12 adjacent the cylindrical side wall 11 with the coil 40 positioned therein. The circumferential groove 38 is sufficiently wide to accommodate the varying diameter of the coil 40. It should be understood, that a portion of the coil 40 adjacent the first end 42 could be overlapped by the second end 44 which may be fixed in position so that it does not move circumferentially within the cavity 16.

Figure 2A:
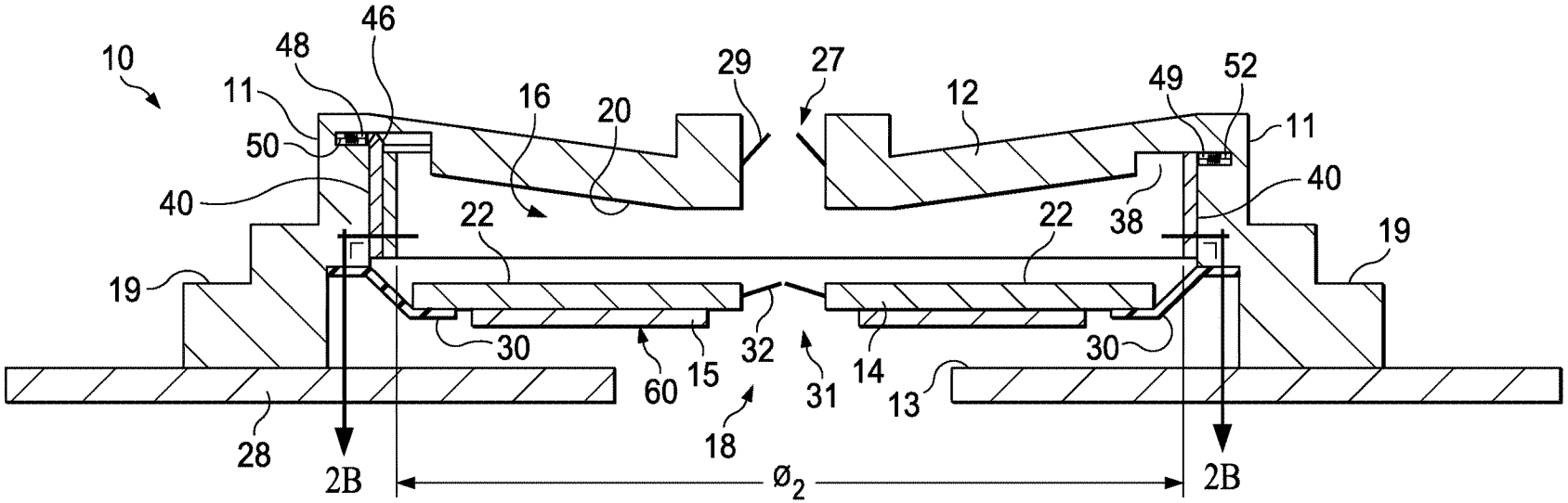
FIG. 2A is a cross-section view of the disc pump having an internal sidewall with an increased diameter.
Figure 2B:
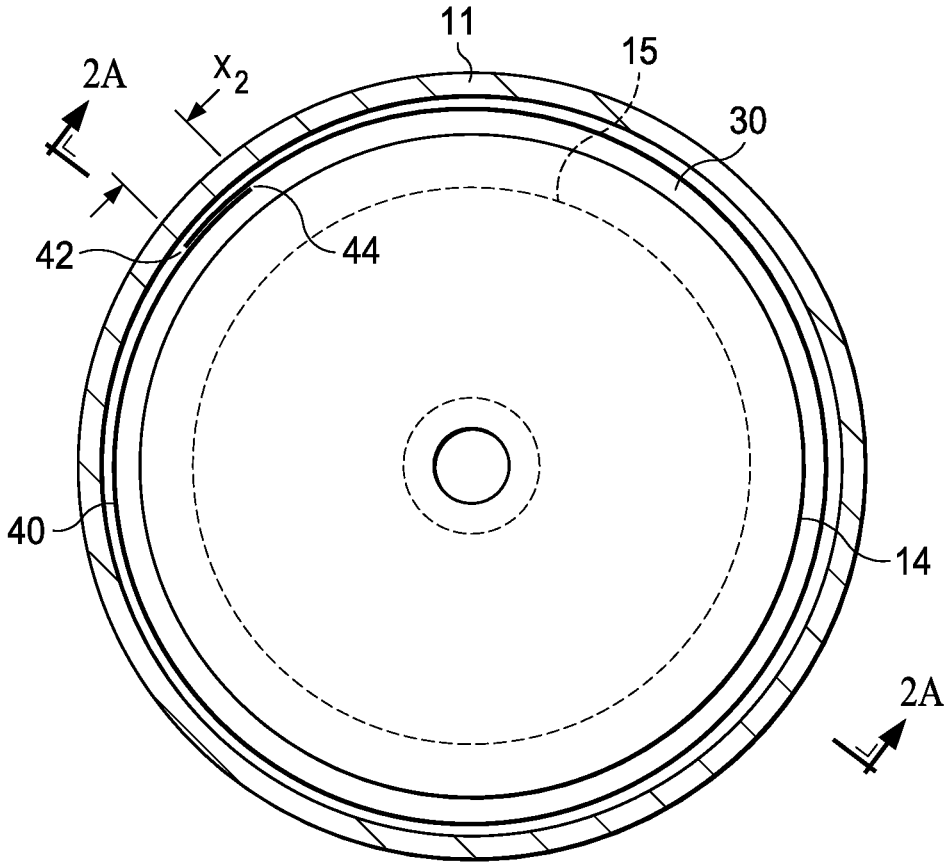
FIG. 2B is a top, section view of the disc pump of FIG. 2A taken along the line 2B-2B, showing the increased diameter of the internal sidewall.

FIGS. 2A and 2B show the pump 10 at raised temperature in which the cavity 16 is expanded due thermal expansion of the coil 40 that may occur when the temperature of the pump 10 has increased. In FIGS. 2A and 2B, the diameter of the cavity has increased to a second diameter ($\acute{Ø}_2$) that is larger than the first diameter ($\acute{Ø}_1$). In addition, at the increased temperature, the portion 40' of the coil 40 is overlapped by the second end 44 of the coil by a second circumferential length ($x_2$). The coil 40 may be configured such that second diameter ($\acute{Ø}_2$) is limited by the diameter of the cavity 16 and in the limited condition, the second circumferential length ($x_2$) is greater than zero.

Returning to FIG. 1A, a first groove 48 extends through the end wall 20 into the end plate 12 and radially outwardly into the cylindrical wall 11. A pin 46 is attached to the first end 42 of the coil 40 and has one and extending into the first groove 48 allowing the first end 42 to move radially but not necessarily circumferentially. In this way, the first end 42 of the coil 40 may be circumferentially fixed in position. A barb 47 may be formed on the end of the pin 46 so that it fits within the first groove 48 with the barbed end extending into the sidewalls of the first groove 48 to prevent the pin 46 from slipping out of the first groove 48. The first end 42 may alternatively be fixed to the cylindrical wall 11 or the end plate 12 using an adhesive, weld, or other coupling mechanism. A second groove 49 on the opposite side of the cavity 16 from the first group 48 extends through the end wall 20 into the end plate 12 and radially outwardly into the cylindrical wall 11. The coil 40 is not fixed in position and is free to move circumferentially and radially with respect to the second groove 49. The coil 40 also includes a mechanism (not shown) to prevent it from slipping out of the second groove 49.

In one embodiment, biasing members 50, 52 are disposed within the grooves 48, 49, respectively, between the coil 40 and the cylindrical side wall 11 to center the coil 40 in the cavity 16 so that the center of the cavity 16 is coincident with the center of the actuator 60. The biasing members 50, 52 may be a spring, for example, each of which have balancing spring constants that maintain the position of the center of the cavity 16 relative to the center of the actuator 60. More specifically, the biasing member 50 in the first groove 48 may bias the first end 42 of the coil 40 toward the center of the cavity 16, while the opposing biasing member 52 in the second groove 49 in the opposite side of the cavity 16 biases the coil 40 toward the center of the cavity 16 from the opposite direction to maintain the position of the center of the cavity 16 coincidental with the center of the actuator 60. In such an embodiment, the interfaces between the biasing members 50, 52, the coil 40, and the cylindrical side wall 11 within the respective grooves may be nearly frictionless so that the force exerted by the biasing members 50, 52 may be minimal so as not to distort the generally circular shape of the coil 40. The balancing between the biasing forces provided by the biasing members 50, 52 bias the position of the coil 40 so that the inside wall 17 forms the variable circumference of the cavity 16 having a center coincidental with the center of the actuator 60. While only two sets of biasing members 51, 52 are shown, it is noted that additional biasing members may be spaced about the perimeter of the cylindrical wall at smaller intervals, such as 90°, 60°, or 45° to bias the coil 40 toward the center of the pump 10.

The end wall 20 defining the cavity 16 is shown as being generally frusto-conical, yet in another embodiment, the end wall 20 defining the inside surfaces of the cavity 16 may include a generally planar surface that is parallel to the actuator 60. A disc pump comprising frusto-conical surfaces is described in more detail in the WO2006/111775 publication, which is incorporated by reference herein. The end plates 12, 13 and cylindrical wall 11 of the disc pump body may be formed from any suitable rigid material including, without limitation, metal, ceramic, glass, or plastic including, without limitation, inject-molded plastic.

The interior plates 14, 15 of the disc pump 10 together form an actuator 60 that is operatively associated with the central portion of the end wall 22. One of the interior plates 14, 15 is formed of a piezoelectric material which may include any electrically active material that exhibits strain in response to an applied electrical signal, such as, for example, an electrostrictive or magnetostrictive material. In one preferred embodiment, for example, the interior plate 15 is formed of piezoelectric material that exhibits strain in response to an applied electrical signal, i.e., the active interior plate. The other one of the interior plates 14, 15 preferably possesses a bending stiffness similar to the active interior plate and may be formed of a piezoelectric material or an electrically inactive material, such as a metal or ceramic. In this preferred embodiment, the interior plate 14 possesses a bending stiffness similar to the active interior plate 15 and is formed of an electrically inactive material, such as a metal or ceramic, i.e., the inert interior plate. When the active interior plate 15 is excited by an electrical current, the active interior plate 15 expands and contracts in a radial direction relative to the longitudinal axis of the cavity 16 causing the interior plates 14, 15 to bend, thereby inducing an axial deflection of the end wall 22 in a direction substantially perpendicular to the end wall 22 (see FIG. 3A). Thus, in operation, the end wall 22 is also referred to as the driven end wall.

In other embodiments not shown, the isolator 30 may support either one of the interior plates 14, 15, whether the active or inert internal plate, from the top or the bottom surfaces depending on the specific design and orientation of the disc pump 10. In another embodiment, the actuator 60 may be replaced by a device in a force-transmitting relation with only one of the interior plates 14, 15 such as, for example, a mechanical, magnetic or electrostatic device, wherein the interior plate may be formed as an electrically inactive or passive layer of material driven into oscillation by such device (not shown) in the same manner as described above.

The disc pump 10 further comprises at least one aperture extending from the cavity 16 to the outside of the disc pump 10, wherein the at least one aperture contains a valve to control the flow of fluid through the aperture. Although the aperture may be located at any position in the cavity 16 where the actuator 60 generates a pressure differential as described below in more detail, one embodiment of the disc pump 10 comprises an outlet aperture 27, located at approximately the center of and extending through the end plate 12. The aperture 27 contains at least one end valve 29 that regulates the flow of fluid in one direction, as indicated by the arrows, so that end valve 29 functions as an outlet valve for the disc pump 10. Any reference to the aperture 27 that includes the end valve 29 refers to that portion of the opening outside of the end valve 29, i.e., outside the cavity 16 of the disc pump 10.

The disc pump 10 further comprises at least one aperture extending through the actuator 60, wherein the at least one aperture contains a valve to control the flow of fluid through the aperture. The aperture may be located at any position on the actuator 60 where the actuator 60 generates a pressure differential. For example, the disc pump 10 comprises an actuator aperture 31 located at approximately the center of and extending through the interior plates 14, 15. The actuator aperture 31 contains an actuator valve 32 that regulates the flow of fluid in one direction to the cavity 16, as indicated by the arrow so that the actuator valve 32 functions as an inlet valve to the cavity 16. The actuator valve 32 enhances the output of the disc pump 10 by augmenting the flow of fluid into the cavity 16 and supplementing the operation of the outlet valve 29 in as described in more detail below.

The dimensions of the cavity 16 described herein should preferably satisfy certain inequalities with respect to the relationship between the height (h) of the cavity 16 and its radius (r) which is the distance from the longitudinal axis of the cavity 16 to the inside wall 17 of the coil 40, or one half of the diameter of the inside wall 17 formed by the coil 40. These equations are as follows:

$$r/h>1.2;\ \text{and}$$

$$h^2/r>4\times10^{-10}\ \text{meters.}$$

In one embodiment of the invention, the ratio of the cavity radius to the cavity height (r/h) is between about 10 and about 50 when the fluid within the cavity 16 is a gas. In this example, the volume of the cavity 16 may be less than about 10 ml. Additionally, the ratio of $h^2/r$ Is preferably within a range between about $10^{-6}$ and about $10^{-7}$ meters where the working fluid is a gas as opposed to a liquid.

Additionally, the cavity 16 disclosed herein should preferably satisfy the following inequality relating the cavity radius (r) and operating frequency (f), which is the frequency at which the actuator 60 vibrates to generate the axial displacement of the end wall 22. The inequality is as follows:

$$\frac{k_0(c_s)}{2\pi f} \le r \le \frac{k_0(c_f)}{2\pi f} \qquad \text{[Equation 1]}$$

wherein the speed of sound in the working fluid within the cavity 16 ($c$) may range between a slow speed ($c_s$) of about 115 m/s and a fast speed ($c_f$) equal to about 1,970 m/s as expressed in the equation above, and $k_0$ is a constant ($k_0$=3.83).

The variance in the speed of sound in the working fluid within the cavity 16 may relate to a number of factors, including the type of fluid within the cavity 16 and the temperature of the fluid. For example, if the fluid in the cavity 16 is an ideal gas, the speed of sound of the fluid may be understood as a function of the square root of the absolute temperature of the fluid. Thus, the speed of sound in the cavity 16 will vary as a result of changes in the temperature of the fluid in the cavity 16 and the size of the cavity 16 may be selected (in part) based on the anticipated temperature of the fluid.

The radius of the cavity and the speed of sound in the working fluid in the cavity are factors in determining the resonant frequency of the cavity 16. The resonant frequency of the cavity 16, or resonant cavity frequency ($f_c$), is the frequency at which the fluid (e.g., air) oscillates into and out of the cavity 16 when the pressure in the cavity is increased relative to the ambient environment. In one preferred embodiment of the disc pump 10, the cavity 16 is sized such that the resonant cavity frequency ($f_c$) is approximately equal to the frequency of the oscillatory motion of the actuator 60 that drives the disc pump 10. In this embodiment, the working fluid is assumed to be air at 60° C., and the resonant frequency of the actuator at an ambient temperature of 20° C. is 21 kHz. However, the anticipated temperature of the fluid may vary. To maintain a constant resonant cavity frequency ($f_c$) over a range of temperatures, the size of the cavity 16 may be dynamically adjusted in response to temperature changes by changing the diameter of the cavity 16, i.e., the inside wall 17 of the coil 40. Although it is preferable that the cavity 16 disclosed herein should satisfy individually the inequalities identified above, the relative dimensions of the cavity 16 should not be limited to cavities having the same height and radius. For example, the cavity 16 may have a slightly different shape requiring different radii or heights creating different frequency responses so that the cavity 16 resonates in a desired fashion to generate the optimal output from the disc pump 10.

As noted above, the disc pump 10 may function as a source of positive pressure adjacent the outlet valve 29 to pressurize a load or as a source of negative or reduced pressure adjacent the actuator inlet valve 32 to depressurize the load, as indicated by the arrows. The load may be, for example, a tissue treatment system that utilizes negative pressure for treatment. Here, the term reduced pressure generally refers to a pressure less than the ambient pressure where the disc pump 10 is located. Although the terms vacuum and negative pressure may be used to describe the reduced pressure, the actual pressure reduction may be significantly less than the pressure reduction normally associated with a complete vacuum. Here, the pressure is negative in the sense that it is a gauge pressure, i.e., the pressure is reduced below ambient atmospheric pressure. Unless otherwise indicated, values of pressure stated herein are gauge pressures. References to increases in reduced pressure typically refer to a decrease in absolute pressure, while decreases in reduced pressure typically refer to an increase in absolute pressure. To provide the reduced pressure, the disc pump 10 comprises at least one actuator valve 32 and at least one end valve 29. In another embodiment, the disc pump 10 may comprise a two-cavity disc pump having a valve on each side of the actuator 60.

Figure 3A:
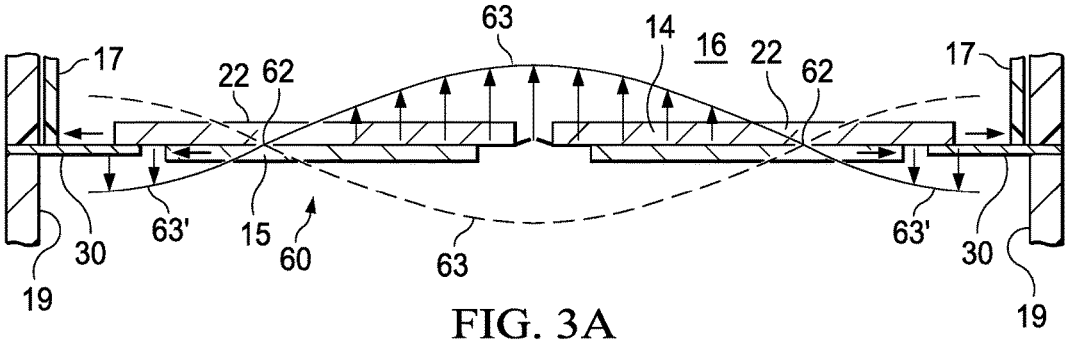
FIG. 3A shows a graph of the axial displacement oscillations for the fundamental bending mode of an actuator of the disc pump.

FIG. 3A shows one possible displacement profile illustrating the axial oscillation of the driven end wall 22 of the cavity 16. The solid curved line and arrows represent the displacement of the driven end wall 22 at one point in time, and the dashed curved line represents the displacement of the driven end wall 22 one half-cycle later. The displacement as shown in this figure and the other figures is exaggerated. Because the actuator 60 is not rigidly mounted at its perimeter, and is instead suspended by the ring-shaped isolator 30, the actuator 60 is free to oscillate about its center of mass in its fundamental mode. In this fundamental mode, the amplitude of the displacement oscillations of the actuator 60 is substantially zero at an annular displacement node 62 located between the center of the driven end wall 22 and the internal sidewall formed by the inside wall 17. The amplitudes of the displacement oscillations at other points on the end wall 22 are greater than zero as represented by the vertical arrows. A central displacement anti-node 63 exists near the center of the actuator 60 and a peripheral displacement anti-node 63' exists near the perimeter of the actuator 60. The central displacement anti-node 63 is represented by the dashed curve after one half-cycle.

Figure 3B:
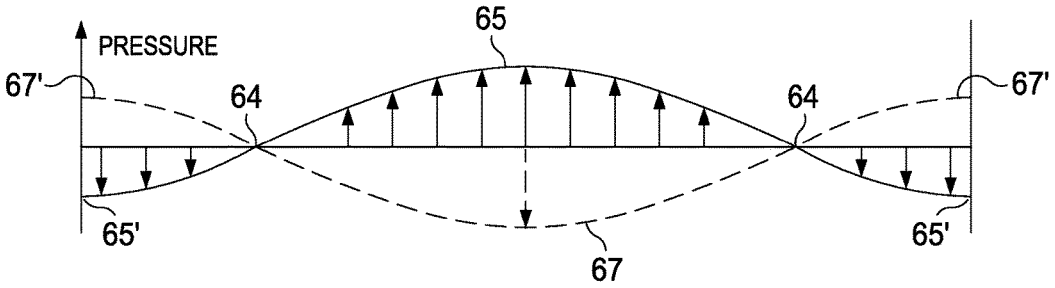
FIG. 3B shows a graph of the pressure oscillations of fluid within the cavity of the disc pump in response to the bending mode shown in FIG. 3A.

FIG. 3B shows one possible pressure oscillation profile illustrating the pressure oscillation within the cavity 16 resulting from the axial displacement oscillations shown in FIG. 3A. The solid curved line and arrows represent the pressure, at one point in time. In this mode and higher-order modes, the amplitude of the pressure oscillations has a peripheral pressure anti-node 65' near the sidewall 18 of the cavity 16. The amplitude of the pressure oscillations is substantially zero at the annular pressure node 64 between the central pressure anti-node 65 and the peripheral pressure anti-node 65'. At the same time, the amplitude of the pressure oscillations as represented by the dashed line has a negative central pressure anti-node 67 near the center of the cavity 16 with a peripheral pressure anti-node 67' and the same annular pressure node 64. For a cylindrical cavity, the radial dependence of the amplitude of the pressure oscillations in the cavity 16 may be approximated by a Bessel function of the first kind. The pressure oscillations described above result from the radial movement of the fluid in the cavity 16 and so will be referred to as the "radial pressure oscillations" of the fluid within the cavity 16 as distinguished from the axial displacement oscillations of the actuator 60.

With further reference to FIGS. 3A and 3B, it can be seen that the radial dependence of the amplitude of the axial displacement oscillations of the actuator 60 (the "mode-shape" of the actuator 60) should approximate a Bessel function of the first kind so as to match more closely the radial dependence of the amplitude of the desired pressure oscillations in the cavity 16 (the "mode-shape" of the pressure oscillation). By not rigidly mounting the actuator 60 at its perimeter and allowing it to vibrate more freely about its center of mass, the mode-shape of the displacement oscillations substantially matches the mode-shape of the pressure oscillations in the cavity 16 thus achieving mode-shape matching or, more simply, mode-matching. Although the mode-matching may not always be perfect in this respect, the axial displacement oscillations of the actuator 60 and the corresponding pressure oscillations in the cavity 16 have substantially the same relative phase across the full surface of the actuator 60 wherein the radial position of the annular pressure node 64 of the pressure oscillations in the cavity 16 and the radial position of the annular displacement node 62 of the axial displacement oscillations of actuator 60 are substantially coincident.

As the actuator 60 vibrates about its center of mass, the radial position of the annular displacement node 62 will necessarily lie inside the radius of the actuator 60 when the actuator 60 vibrates in its fundamental bending mode as illustrated in FIG. 3A. Thus, to ensure that the annular displacement node 62 is coincident with the annular pressure node 64, the radius of the actuator ($r_{act}$) should preferably be greater than the radius of the annular pressure node 64 to optimize mode-matching. Assuming again that the pressure oscillation in the cavity 16 approximates a Bessel function of the first kind, the radius of the annular pressure node 64 would be approximately 0.63 of the radius (a) of the central portion of the end wall 22. Therefore, the radius ($r_{act}$) of the actuator 60 should preferably satisfy the following inequality: $r_{act} \geq 0.63r$.

The isolator 30 may be a flexible membrane that enables the edge of the actuator 60 to move more freely as described above by bending and stretching in response to the vibration of the actuator 60 as shown by the displacement at the peripheral displacement anti-node 63' in FIG. 3A. The flexible membrane overcomes the potential dampening effects of the cylindrical wall 11 on the actuator 60 by providing a low mechanical impedance support between the actuator 60 and the cylindrical wall 11 of the disc pump 10, thereby reducing the dampening of the axial oscillations at the peripheral displacement anti-node 63' of the actuator 60. Essentially, the flexible membrane minimizes the energy being transferred from the actuator 60 to the cylindrical wall 11 with the outer peripheral edge of the flexible membrane remaining substantially stationary. Consequently, the annular displacement node 62 will remain substantially aligned with the annular pressure node 64 to maintain the mode-matching condition of the disc pump 10. Thus, the axial displacement oscillations of the driven end wall 22 continue to efficiently generate oscillations of the pressure within the cavity 16 from the central pressure anti-nodes 65, 67 to the peripheral pressure anti-nodes 65', 67' at the internal sidewall as shown in FIG. 3B.

Figure 4:
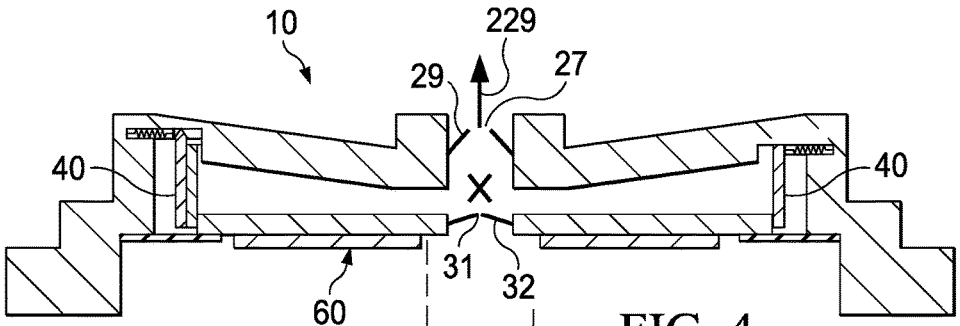
FIG. 4 shows a cross-section view of the disc pump wherein the two valves of the pump are represented by a single valve in FIG. 5.

Referring to FIG. 4, the disc pump 10 of FIG. 1 is shown with the valves 29, 32, both of which are substantially similar in structure as represented, for example, by a valve 110 having a center portion 111 shown in FIGS. 5 and 7A-7C. The valve 110 allows fluid to flow in only one direction, as indicated by the arrows 124, and may be a check valve or any other valve that allows fluid to flow in only one direction. Some valve types may regulate fluid flow by switching between an open and closed position. For such valves to operate at the high frequencies generated by the actuator 60, the valves 29, 32 have an extremely fast response time such that they are able to open and close on a timescale significantly shorter than the timescale of the pressure variation. One embodiment of the valves 29, 32 achieves this by employing an extremely light flap valve, which has low inertia and consequently is able to move rapidly in response to changes in relative pressure across the valve structure.

Figure 5:
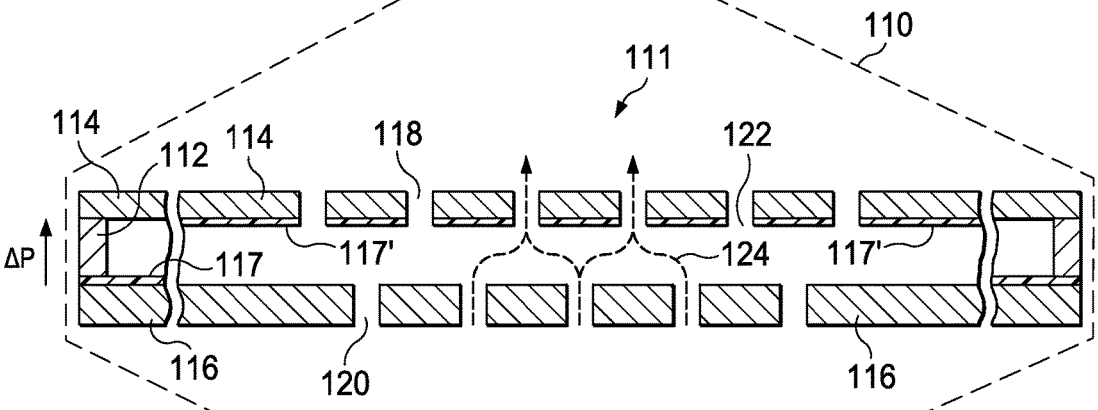
FIG. 5 shows a cross-sectional, exploded view of a disc pump valve.

Referring to FIG. 5, the valve 110 is a flap valve for the disc pump 10 according to an illustrative embodiment. The valve 110 comprises a substantially cylindrical wall 112 that is ring-shaped and closed at one end by a retention plate 114 and at the other end by a sealing plate 116. The inside surface of the wall 112, the retention plate 114, and the sealing plate 116 form a cavity 115 within the valve 110. The valve 110 further comprises a substantially circular flap 117 disposed between the retention plate 114 and the sealing plate 116, but adjacent the sealing plate 116. In this sense, the flap 117 is considered to be "biased" against the sealing plate 116. The peripheral portion of the flap 117 is sandwiched between the sealing plate 116 and the ring-shaped wall 112 so that the motion of the flap 117 is restrained in the plane substantially perpendicular the surface of the flap 117. The motion of the flap 117 in such plane may also be restrained by the peripheral portion of the flap 117 being attached directly to either the sealing plate 116 or the wall 112, or by the flap 117 being a close fit within the ring-shaped wall 112, in an alternative embodiment. The remainder of the flap 117 is sufficiently flexible and movable in a direction substantially perpendicular to the surface of the flap 117, so that a force applied to either surface of the flap 117 will motivate the flap 117 between the sealing plate 116 and the retention plate 114.

The retention plate 114 and the sealing plate 116 both have holes 118 and 120, respectively, which extend through each plate. The flap 117 also has holes 122 that are generally aligned with the holes 118 of the retention plate 114 to provide a passage through which fluid may flow as indicated by the dashed arrows 124 in FIG. 5. The holes 122 in the flap 117 may also be partially aligned, i.e., having only a partial overlap, with the holes 118 in the retention plate 114. Although the holes 118, 120, 122 are shown to be of substantially uniform size and shape, they may be of different diameters or even different shapes without limiting the scope of the invention. In one embodiment of the invention, the holes 118 and 120 form an alternating pattern across the surface of the plates in a top view. In other embodiments, the holes 118, 120, 122 may be arranged in different patterns without affecting the operation of the valve 110 with respect to the functioning of the individual pairings of holes 118, 120, 122 as illustrated by individual sets of the dashed arrows 124. The pattern of holes 118, 120, 122 may be designed to increase or decrease the number of holes to control the total flow of fluid through the valve 110 as necessary. For example, the number of holes 118, 120, 122 may be increased to reduce the flow resistance of the valve 110 to increase the total flow rate of the valve 110.

Figure 7A:
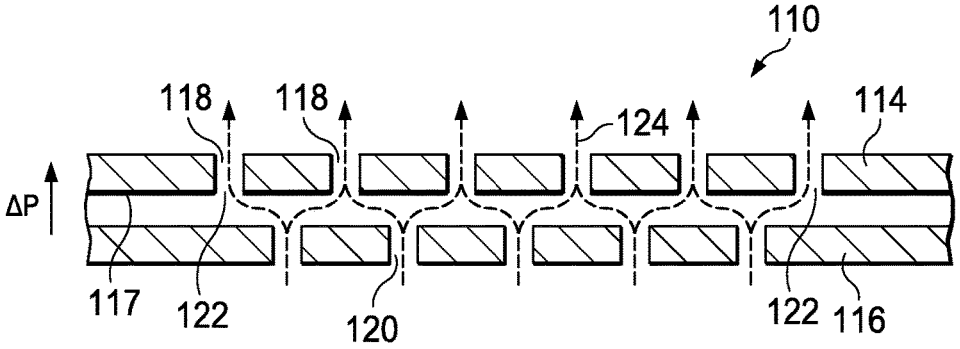
FIG. 7A shows a cross-section view of the valve in an open position when fluid flows through the valve.
Figure 7B:
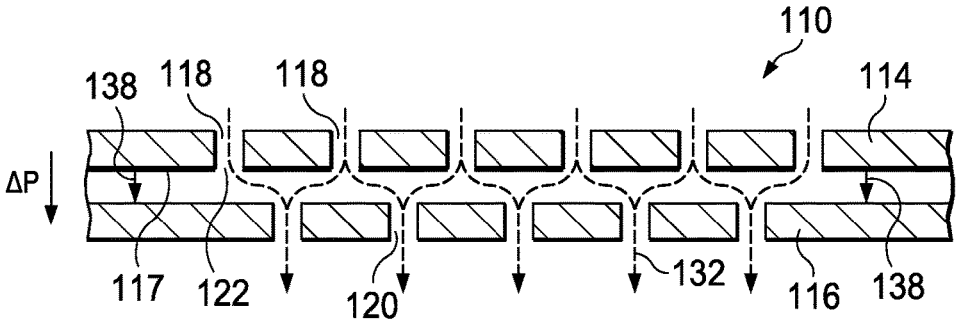
FIG. 7B shows a cross-section view of the valve in transition between the open and closed positions before closing.
Figure 7C:
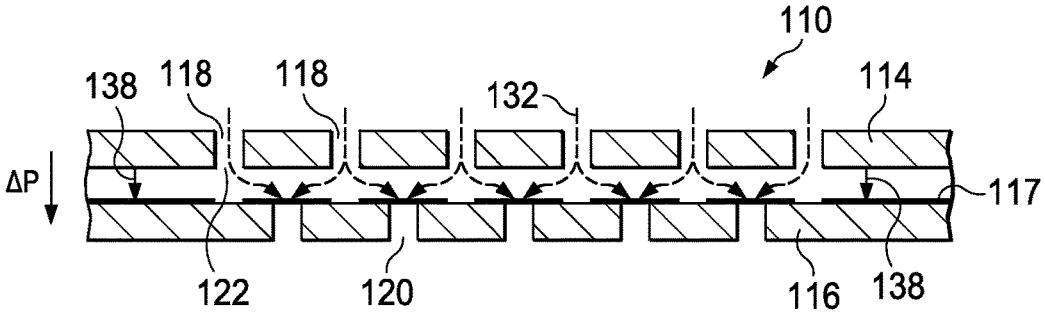
FIG. 7C shows a cross-section view of the valve in a closed position when fluid flow is blocked by the valve flap.

FIGS. 7A-7C illustrate how the flap 117 is motivated between the sealing plate 116 and the retention plate 114 when a force applied to either surface of the flap 117. When no force is applied to either surface of the flap 117 to overcome the bias of the flap 117, the valve 110 is in a "normally closed" position because the flap 117 is disposed adjacent the sealing plate 116 where the holes 122 of the flap are offset or not aligned with the holes 118 of the sealing plate 116. In this "normally closed" position, the flow of fluid through the sealing plate 116 is substantially blocked or covered by the non-perforated portions of the flap 117 as shown in FIG. 7C. When pressure is applied against either side of the flap 117 that overcomes the bias of the flap 117 and motivates the flap 117 away from the sealing plate 116 towards the retention plate 114 as shown in FIG. 7A, the valve 110 moves from the normally closed position to an "open" position over a time period, i.e., an opening time delay ($T_o$), allowing fluid to flow in the direction indicated by the dashed arrows 124. When the pressure changes direction as shown in FIG. 7B, the flap 117 will be motivated back towards the sealing plate 116 to the normally closed position. When this happens, fluid will flow for a short time period, i.e., a closing time delay ($T_c$), in the opposite direction as indicated by the dashed arrows 132 until the flap 117 seals the holes 120 of the sealing plate 116 to substantially block fluid flow through the sealing plate 116 as shown in FIG. 7C. In other embodiments of the invention, the flap 117 may be biased against the retention plate 114 with the holes 118, 122 aligned in a "normally open" position. In this embodiment, applying positive pressure against the flap 117 will be necessary to motivate the flap 117 into a "closed" position. Note that the terms "sealed" and "blocked" as used herein in relation to valve operation are intended to include cases in which substantial (but incomplete) sealing or blockage occurs, such that the flow resistance of the valve is greater in the "closed" position than in the "open" position.

The operation of the valve 110 is generally a function of the change in direction of the differential pressure ($\Delta P$) of the fluid across the valve 110. In FIG. 7B, the differential pressure has been assigned a negative value ($-\Delta P$) as indicated by the downward pointing arrow. When the differential pressure has a negative value ($-\Delta P$), the fluid pressure at the outside surface of the retention plate 114 is greater than the fluid pressure at the outside surface of the sealing plate 116. This negative differential pressure ($-\Delta P$) drives the flap 117 into the fully closed position, wherein the flap 117 is pressed against the sealing plate 116 to block the holes 120 in the sealing plate 116, thereby substantially preventing the flow of fluid through the valve 110. When the differential pressure across the valve 110 reverses to become a positive differential pressure ($+\Delta P$) as indicated by the upward pointing arrow in FIG. 7A, the flap 117 is motivated away from the sealing plate 116 and towards the retention plate 114 into the open position. When the differential pressure has a positive value ($+\Delta P$), the fluid pressure at the outside surface of the sealing plate 116 is greater than the fluid pressure at the outside surface of the retention plate 114. In the open position, the movement of the flap 117 unblocks the holes 120 of the sealing plate 116 so that fluid is able to flow through them and the aligned holes 122 and 118 of the flap 117 and the retention plate 114, respectively, as indicated by the dashed arrows 124.

When the differential pressure across the valve 110 changes from a positive differential pressure ($+\Delta P$) back to a negative differential pressure ($-\Delta P$) as indicated by the downward pointing arrow in FIG. 7B, fluid begins flowing in the opposite direction through the valve 110 as indicated by the dashed arrows 132, which forces the flap 117 back toward the closed position shown in FIG. 7C. In FIG. 7B, the fluid pressure between the flap 117 and the sealing plate 116 is lower than the fluid pressure between the flap 117 and the retention plate 114. Thus, the flap 117 experiences a net force, represented by arrows 138, which accelerates the flap 117 toward the sealing plate 116 to close the valve 110. In this manner, the changing differential pressure cycles the valve 110 between closed and open positions based on the direction (i.e., positive or negative) of the differential pressure across the valve 110.

When the differential pressure across the valve 110 reverses to become a positive differential pressure (+ΔP) as shown in FIG. 7A, the flap 117 is motivated away from the sealing plate 116 against the retention plate 114 into the open position. In this position, the movement of the flap 117 unblocks the holes 120 of the sealing plate 116 so that fluid is permitted to flow through them and the aligned holes 118 of the retention plate 114 and the holes 122 of the flap 117 as indicated by the dashed arrows 124. When the differential pressure changes from the positive differential pressure (+ΔP) back to the negative differential pressure (−ΔP), fluid begins to flow in the opposite direction through the valve 110 (see FIG. 7B), which forces the flap 117 back toward the closed position (see FIG. 7C). Thus, as the pressure oscillations in the cavity 16 cycle the valve 110 between the normally closed position and the open position, the disc pump 10 provides reduced pressure every half cycle when the valve 110 is in the open position.

Figure 6:
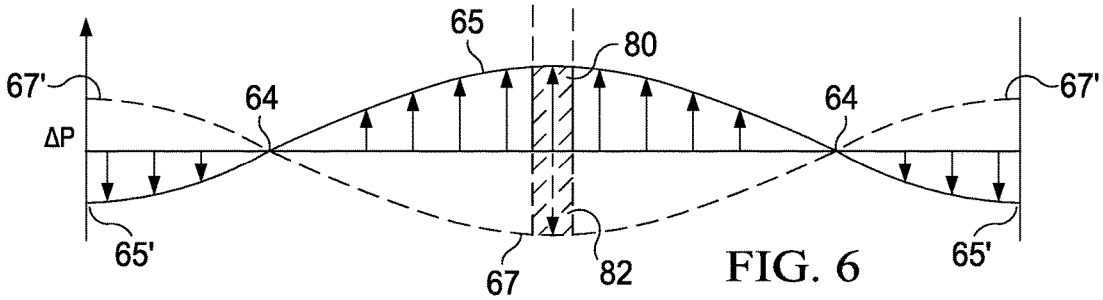
FIG. 6 shows a graph of pressure oscillations of fluid of within the cavity of the disc pump to illustrate the pressure differential applied across the valve of FIG. 5, as indicated by the dashed lines.

As indicated above, the operation of the valve 110 may be a function of the change in direction of the differential pressure (ΔP) of the fluid across the valve 110. The differential pressure (ΔP) is assumed to be substantially uniform across the entire surface of the retention plate 114 because (i) the diameter of the retention plate 114 is small relative to the wavelength of the pressure oscillations in the cavity 115, and (ii) the valve 110 is located near the center of the cavity 16 where the amplitude of the positive central pressure anti-node 65 is relatively constant as indicated by the positive square-shaped portion 80 of the positive central pressure anti-node 65 and the negative square-shaped portion 82 of the negative central pressure anti-node 67 shown in FIG. 6. Therefore, there is virtually no spatial variation in the pressure across the center portion 111 of the valve 110.

Figures 8A, 8B:
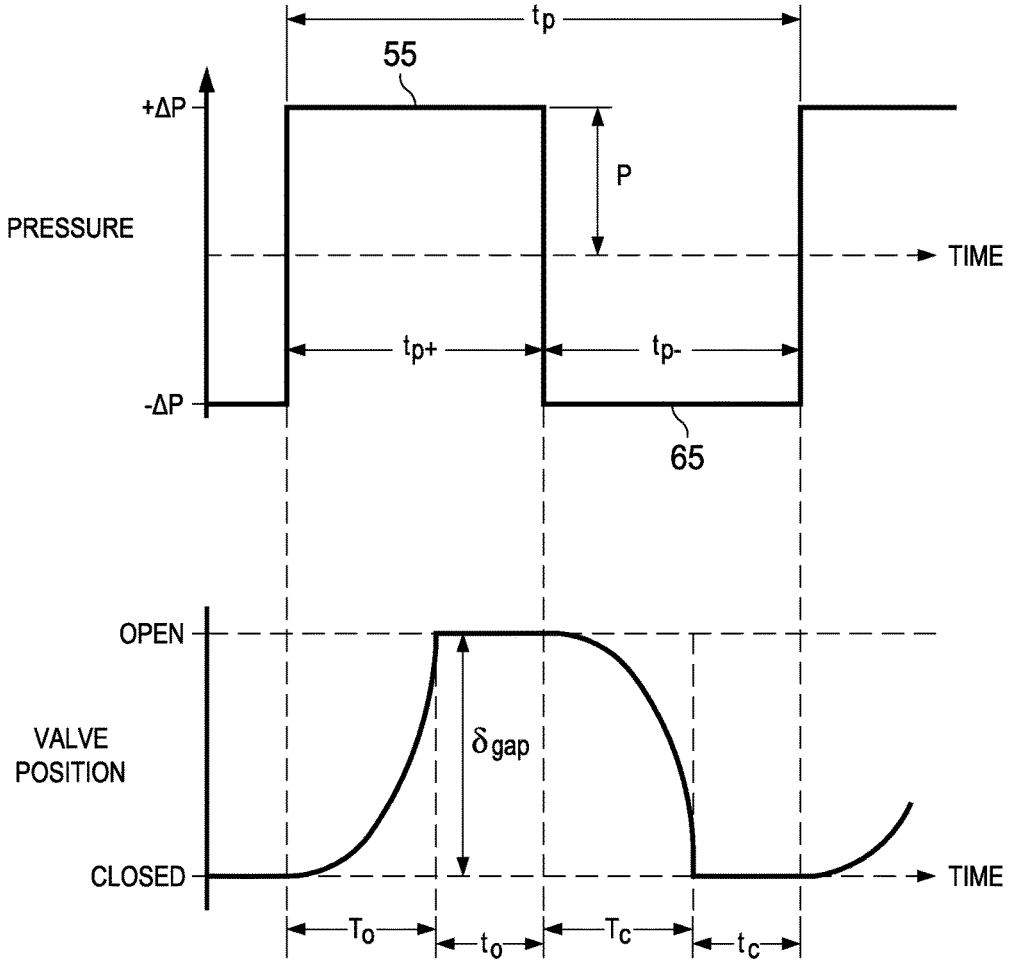
FIG. 8A shows a pressure graph of an oscillating differential pressure applied across the valve of FIG. 5 according to an illustrative embodiment.
FIG. 8B shows a fluid-flow graph of an operating cycle of the valve between an open and closed position.

FIG. 8B further illustrates the dynamic operation of the valve 110 when it is subject to a differential pressure which varies in time between a positive value (+ΔP) and a negative value (−ΔP). While in practice the time-dependence of the differential pressure across the valve 110 may be approximately sinusoidal, the time-dependence of the differential pressure across the valve 110 is approximated as varying in the square-wave form shown in FIG. 8A to facilitate explanation of the operation of the valve 110. The positive differential pressure 80 is applied across the valve 110 over the positive pressure time period (tp+) and the negative differential pressure 82 is applied across the valve 110 over the negative pressure time period (tp−) of the square wave. FIG. 8B illustrates the motion of the flap 117 in response to this time-varying pressure. As differential pressure (ΔP) switches from negative 82 to positive 80, the valve 110 begins to open and continues to open over an opening time delay ($T_o$) until the valve flap 117 meets the retention plate 114 as also described above and as shown by the graph in FIG. 8B. As differential pressure (ΔP) subsequently switches back from positive differential pressure 80 to negative differential pressure 82, the valve 110 begins to close and continues to close over a closing time delay ($T_c$) as also described above and shown in FIG. 8B.

The retention plate 114 and the sealing plate 116 should be strong enough to withstand the fluid pressure oscillations to which they are subjected without significant mechanical deformation. The retention plate 114 and the sealing plate 116 may be formed from any suitable rigid material, such as glass, silicon, ceramic, or metal. The holes 118, 120 in the retention plate 114 and the sealing plate 116 may be formed by any suitable process including chemical etching, laser machining, mechanical drilling, powder blasting, and stamping. In one embodiment, the retention plate 114 and the sealing plate 116 are formed from sheet steel between 100 and 200 microns thick, and the holes 118, 120 therein are formed by chemical etching. The flap 117 may be formed from any lightweight material, such as a metal or polymer film. In one embodiment, when fluid pressure oscillations of 20 kHz or greater are present on either the retention plate side or the sealing plate side of the valve 110, the flap 117 may be formed from a thin polymer sheet between 1 micron and 20 microns in thickness. For example, the flap 117 may be formed from polyethylene terephthalate (PET) or a liquid crystal polymer film approximately three microns in thickness.

To generate the displacement and pressure oscillations described above with regard to FIGS. 3A and 3B, the piezoelectric actuator 60 is driven at its fundamental resonant frequency, which is the fundamental bending mode that creates the pressure oscillations in the cavity 16 to drive the disc pump 10. In one embodiment, the fundamental mode of resonance for the piezoelectric actuator is about 21 kHz at an ambient temperature, e.g., 20° C. To enhance pump efficiency, the resonant cavity frequency ($f_c$) is approximately equivalent to the fundamental mode of resonance for the piezoelectric actuator. Like the resonant cavity frequency ($f_c$), however, the fundamental bending mode of the actuator 60 may also vary depending on the temperature of the disc pump 10. This variability results from the thermal effects on the piezoelectric materials that form the actuator 60, as well as the shape of the actuator 60. For example, the resonant frequency of an illustrative piezoelectric actuator may increase or decrease as temperature increases.

Figure 9:
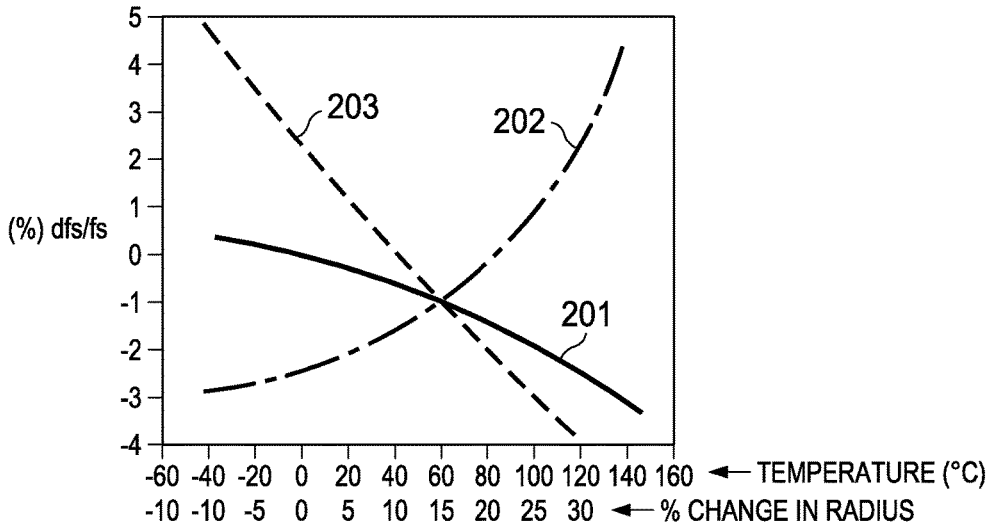
FIG. 9 is a graph illustrating the temperature dependence of the resonant frequency of an illustrative PZT ceramic piezoelectric actuator material, the temperature dependence of the resonant frequency of a pump cavity, and the size dependence of the resonant frequency of the pump cavity.

The graph of FIG. 9 illustrates generalizations of the temperature dependence of the resonant frequency of the actuator 60 and the temperature and size dependence of the resonant frequency of the cavity 16. More specifically, the graph shows the temperature and size dependence on the elements of the disc pump 10. For example, line 201 shows a percentage increase or decrease (δfs) of the resonant frequency (fs) of the actuator 60 as a function of temperature. Line 201 illustrates that the resonant frequency of an illustrative piezoelectric actuator decreases gradually as temperature increases. In another embodiment that employs an alternative piezoelectric material, the resonant frequency of the piezoelectric actuator may increase as temperature increases. Line 202 shows a divergent increase in the resonant frequency of the cavity 16 as temperature increases that might result from the increase in the temperature of the fluid within the cavity 16. FIG. 9 illustrates that, given a disc pump 10 having an actuator 60 with temperature-dependent properties similar to those shown in FIG. 9, there may be only a small range of temperatures over which both the actuator 60 and cavity 16 having matching or nearly-matching resonant frequencies, e.g., at 60° C. That said, line 203 illustrates the size-dependence of the resonant frequency of the cavity 16, and shows that as the cavity 16 increases in size (e.g., the radius), the resonant cavity frequency ($f_c$) decreases. Thus, by varying the size of the cavity 16, temperature-dependent increases or decreases in the resonant cavity frequency ($f_c$) may be offset by increasing or decreasing the diameter of the cavity 16. In this way, the resonant cavity frequency ($f_c$) can be held constant or varied to match the resonant frequency of the actuator 60 over a broader range of temperatures.

When the disc pump 10 does not include a mechanism for compensating for temperature changes, the disc pump 10 may have a start-up temperature approximately equal to the temperature of the ambient environment. The pump 10 may also have an operating temperature that approaches the target temperature (T) as the disc pump 10 warms up as result of the energy dissipated during pump operation. The pump 10 may function at less than complete efficiency in part because, at startup when the temperature of the pump 10 is below the target temperature (T), the resonant frequency of the actuator 60 and the resonant cavity frequency ($f_c$) may be different. Additionally, both the resonant frequency of the actuator 60 and the resonant cavity frequency ($f_c$) may be different from the drive frequency which may correspond to the resonant frequency of the actuator at the target temperature (T). When the pump 10 and fluid within the pump cavity 16 heat beyond the target temperature (T), a similar divergence may occur between the resonant cavity frequency ($f_c$), resonant frequency of the actuator 60, and drive frequency.

To offset or mitigate the thermal effects on operation of the disc pump 10, the resonant cavity frequency ($f_c$) may be maintained at a constant value despite variances in temperature. Similarly, the resonant cavity frequency ($f_c$) may be reduced as temperature increases to account for the effects of variance in temperature. For example, it may be desirable to alter the resonant cavity frequency ($f_c$) so that the resonant cavity frequency ($f_c$) and fundamental mode of resonance of the actuator 60 remain roughly equal despite increases or decreases in pump temperatures. Because the coil 40 described above has a variable diameter defined by the inside wall 17, the size of the cavity 16 may be adjusted to vary the resonant cavity frequency ($f_c$) to accommodate the temperature variations occurring prior to achieving the target temperature (T). In one embodiment, the coil 40 is configured to increase in diameter as temperature increases, thereby increasing the volume of the cavity 16 and decreasing the resonant cavity frequency ($f_c$) to compensate for the increasing temperature of the disc pump 10. By configuring the diameter of the coil 40 to increase with temperature at a predetermined rate, the expansion of the cavity 16 causes a reduction in the resonant cavity frequency ($f_c$) that matches the temperature-related reduction in the resonant frequency of the actuator 60.

Figure 1C:
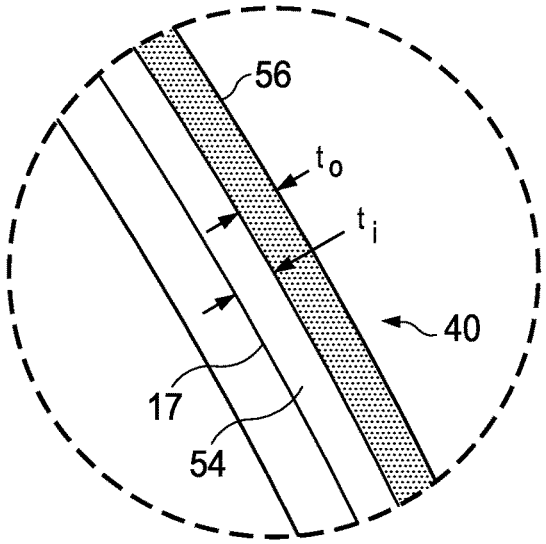
FIG. 1C is a detail, cross-section view of the internal sidewall shown in FIGS. 1A and 1B.
Figure 1E:
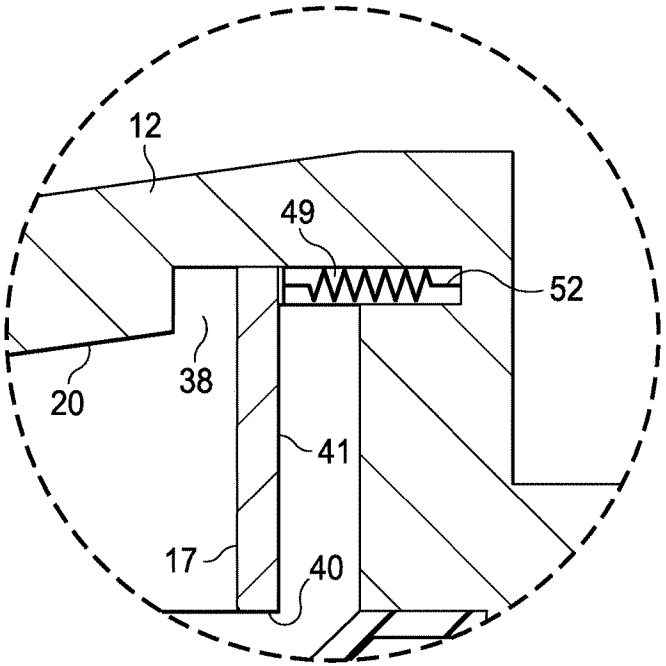
FIG. 1E is a detail, cross-section view of the portion of the internal sidewall located at the opposite side of the pump from the coupling illustrated in FIG. 1D.
Figure 1F:
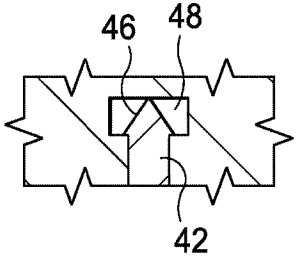
FIG. 1F is a detail, cross-section view of a first end of a coil of the pump taken along line 1F-1F of FIG. 1D.
Figure 1D:
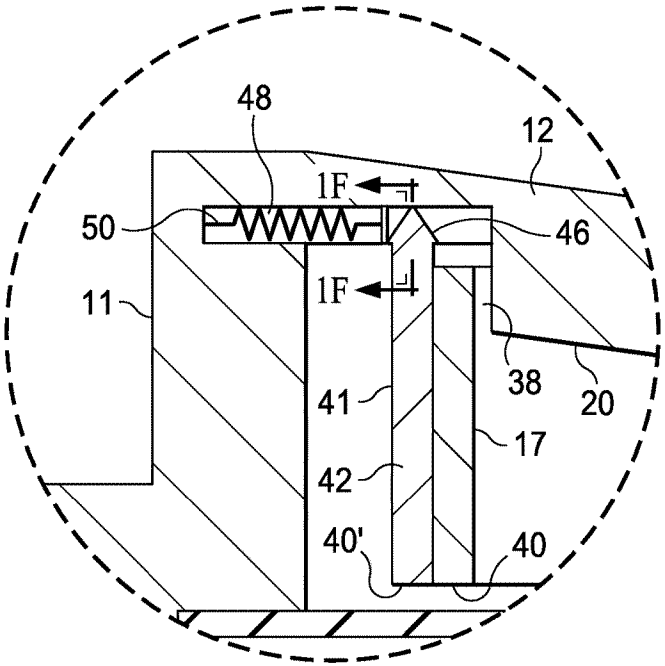
FIG. 1D is a detail, cross-section view of a coupling between the disc pump body and an internal sidewall.

Referring again to FIGS. 1A-1E and more specifically 2A-2B, the inside wall 17 of the coil 40 has a variable diameter. In one embodiment, the coil 40 is formed from a bi-metal material comprising two laminated metal layers, an inner layer 54 and an outer layer 56, as shown in FIG. 1C. The inner layer 54 is steel and has an inner thickness $t_i$, and the outer layer 56 has an outer thicknesses $t_o$. The steel, inner layer 54 of the coil 40 has a greater thermal expansion coefficient than the copper, outer layer 56 of the coil 40. Because of the difference in the thermal expansion coefficients and the orientation of materials that form the inner layer 54 and outer layer 56, the diameter of the inside wall 17 of the coil 40 increases as the temperature increases within the cavity 16. The thermal expansion characteristics of the coil 40 dynamically alters the size of the cavity 16 in response to temperature changes within the cavity 16.

In an embodiment, the change in the diameter of the cavity 16 or the inside wall 17 is defined by the following equation:

$$\delta\phi = 2\left[\frac{E_i^2 t_i^4 + 4E_i E_o t_i^3 t_o + 6E_i E_o t_i^2 t_o^2 + 4E_i E_o t_o^3 t_i + E_o^4 t_o^4}{6E_i E_o (t_i + t_o) t_i t_o [(\alpha_i - \alpha_o)\Delta T]}\right] \quad \text{[Equation 2]}$$

where δØ is the change in the diameter of the cavity 16 or the inside wall 17, ΔT is the change in the temperature, $E_i$ is the Young's modulus of the inner layer 54, $E_o$ is the Young's modulus of the outer layer 56, αi is the coefficient of thermal expansion of the inner layer 54, $\alpha_o$ is the coefficient of thermal expansion of the outer layer 56, $t_i$ is the thickness of the inner layer 54, and $t_o$ is the thickness of the outer layer 56. Knowing the value of the desired change in diameter (δØ) that corresponds to a desired change in the resonant cavity frequency ($f_c$), Equation 2 may be used with a known ΔT to solve for a range of materials and material thicknesses that may be used to form the coil 40 from suitable bimetallic materials. In fact, by varying the type and thickness of the materials used, the coil 40 may be configured to expand or contract at a predetermined rate that corresponds to anticipated changes of the temperature in the pump cavity 16.

By varying the size of the cavity 16 using the coil 40, the resonant cavity frequency ($f_c$) can be altered to dynamically match the resonant frequency of the actuator 60. By selecting laminate layers of varying thicknesses that have different thermal expansion characteristics, the coil 40 may be configured to increase in diameter as the operating temperature of the disc pump 10 increases. For example, referring more specifically to FIGS. 1A and 1B, and 2A and 2B, the diameter (Ø) of the cavity 16 increases from a first diameter ($Ø_1$) when the actuator 60 is first energized to a second diameter ($Ø_2$) when the disc pump 10 reaches the target temperature (T). This correlation of the diameter of the internal sidewall to the pump temperature allows for improved pump efficiency by synchronizing the resonant cavity frequency ($f_c$) and the fundamental resonant frequency of the actuator 60 because the resonant cavity frequency ($f_c$) decreases with temperature at approximately the same rate as the resonant frequency of the actuator 60.

The ability to match the resonant cavity frequency ($f_c$) of the cavity 16 to the resonant frequency of the actuator 60 over a range of temperatures is of particular use when the working duty cycle of the disc pump 10 is unknown. For instance, if the disc pump 10 is coupled to a load such as a reduced-pressure wound dressing that has a leak, the disc pump 10 may remain operational almost constantly and heat up beyond the target temperature (T), which may also cause a divergence between the resonant frequencies. Conversely, if the disc pump 10 is coupled to a small, well-sealed load, the disc pump 10 may never run long enough to significantly warm and may remain constantly below the target temperature (T).

Although the coil 40 described above comprises a single piece of material having a generally circular profile to define the inside wall 17 and internal sidewall, other embodiments may be used to form the internal sidewall. For example, the internal sidewall may be formed from a plurality of arcuate, coil segments (not shown) that are coupled to the cylindrical sidewall 11 at multiple points to form the cavity 16. In this embodiment, each arcuate segment may be disposed within the cavity 16 to adjust the diameter of the cavity 16. The arcuate segments may be biased using a combination of a radial grooves and biasing members as described above, cam and pawl mechanisms, or torsion springs. Each arcuate segment may be temperature sensitive to adjust the diameter of the cavity 16 so that the resonant cavity frequency ($f_c$) of the cavity 16 matches the resonant frequency of the actuator 60 over a desired range of temperatures. Alternatively, the biasing members may be temperature sensitive to adjust the diameter of the cavity 16 in a similar fashion. In another embodiment, the disc pump 10 includes an alternative mechanism for biasing the center of circular coil 40 toward the center of the cavity 16 that comprises a circumferential groove about the periphery of the cylindrical wall 11 to house spring-loaded pawls or cam mechanisms to exert a biasing force on the coil 40.

While the coil 40 described above comprises a bimetal laminate formed from, for example, copper and steel, other materials may form the coil 40. For example, other materials with differential thermal expansion characteristics may form the inside wall of the coil 40 having a variable diameter. Such other materials may include other metals or polymers, and phase change alloys such as Nitinol. In one embodiment, one or more phase change alloys having distinct trigger temperatures may be used to form the coil 40 so that the coil changes in shape as the distinct trigger temperatures of the alloys are reached. In such an embodiment, the coil 40 may adapt to have one or more diameters that correspond to the trigger temperatures of the one or more phase change alloys.

Figure 10:
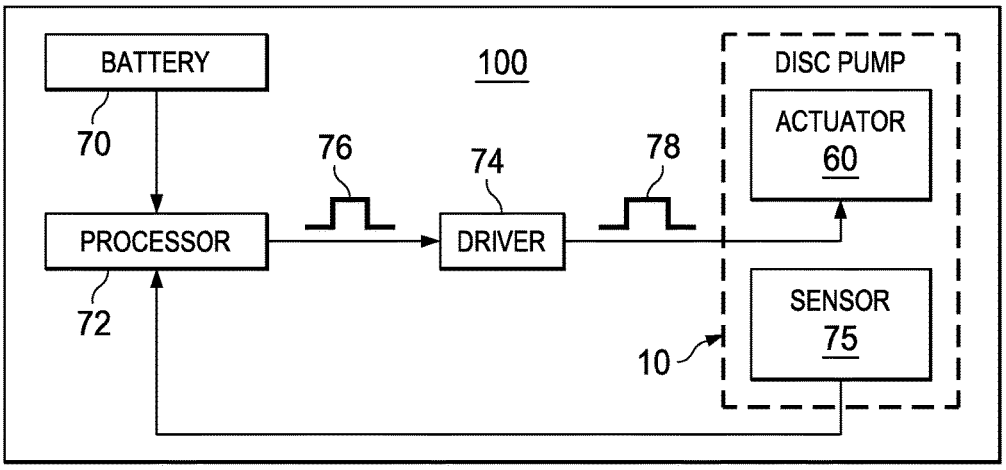
FIG. 10 is a block diagram showing an illustrative disc pump system.

A representative disc pump system 100 that includes the coil 40 is shown in FIG. 10. The disc pump system 100 includes a battery 70 that provides power to a processor 72 and a driver 74. The processor 72 communicates a control signal 76 to the driver 74, which in turn applies a drive signal 78 to the actuator 60 of the disc pump 10. In an embodiment, the driver 74 is a drive circuit having an output electrically coupled to the actuator 60. The drive circuit provides the drive signal 78 to the actuator 60 at a frequency (f), which may be the fundamental resonant frequency of the actuator 60. The disc pump 10 may also include a sensor 75, such as a temperature sensor, to determine the temperature of the components of the disc pump 10, including the actuator 60 and coil 40. The temperature sensor 75 is communicatively coupled to the processor 72, which may apply temperature data received from the sensor 75 to derive the control signal 76. Using the temperature data, the processor 72 may determine the temperature related variance in the resonant frequencies of the actuator 60 and resonant cavity frequency ($f_c$). Based on this determination, the processor 72 may vary the control signal 76 to cause the driver 78 to vary the drive signal 78 to account for any temperature related variances in the resonant frequency of the actuator 60 and cavity 16.

It should be apparent from the foregoing that an invention having significant advantages has been provided. While the invention is shown in only a few of its forms, it is not so limited and is susceptible to various changes and modifications without departing from the spirit thereof.

We claim:

1. A disc pump comprising:

a pump body having a cylindrically shaped sidewall closed at both ends by a first end wall and a driven end wall having a central portion and a peripheral portion extending radially outwardly from the central portion;

an internal sidewall having a diameter and comprising a coil coupled at one end to the first end wall, the internal sidewall disposed within the cylindrically shaped sidewall, wherein the internal sidewall, the first end wall, and the driven end wall define a cavity;

an actuator operatively associated with the central portion of the driven end wall to cause oscillatory motion of the driven end wall at a drive frequency (f), thereby generating displacement oscillations of the driven end wall resulting in a change in temperature, the diameter of the internal sidewall being variable in response to the change in temperature;

an isolator operatively associated with the peripheral portion of the driven end wall to reduce dampening of the displacement oscillations;

a first aperture disposed at any location in either one of the first end wall and the driven end wall other than at an annular node;

a second aperture disposed at any location in the pump body other than the location of the first aperture;

a valve disposed in at least one of the first aperture and the second aperture;

whereby the displacement oscillations generate corresponding pressure oscillations of a fluid within the cavity of the pump body causing fluid flow through the first aperture and second aperture when in use.

2. The disc pump of claim 1, wherein the internal sidewall's diameter increases in response to an increase in temperature within the cavity and decreases in response to a decrease in temperature within the cavity.

3. The disc pump of claim 1, wherein the internal sidewall comprises a metal.

4. The disc pump of claim 1, wherein the internal sidewall comprises a bimetal laminate.

5. The disc pump of claim 4, wherein the bimetal laminate comprises copper and steel.

6. The disc pump of claim 1, wherein the internal sidewall comprises a phase change alloy.

7. The disc pump of claim 1, wherein the one end of the coil comprises a pin that is coupled to the first end wall.

8. The disc pump of claim 1, wherein:

the coil comprises a barbed end;

the first end wall comprises a groove; and the barbed end of the coil is inserted into the groove of the first end wall.

9. The disc pump of claim 1, wherein the cavity has a resonant cavity frequency ($f_c$) matching the drive frequency (f).

10. The disc pump of claim 9, wherein the change in size of the diameter of the internal sidewall changes a volume of the cavity which compensates for the change in temperature and allows the resonant cavity frequency ($f_c$) to better match with the drive frequency (f).

* * * * *